US009963857B2

(12) United States Patent
Ruvang

(10) Patent No.: US 9,963,857 B2
(45) Date of Patent: May 8, 2018

(54) WEAR MEMBERS FOR EXCAVATION IMPLEMENTS

(71) Applicant: BLACK CAT BLADES LTD., Edmonton (CA)

(72) Inventor: John A. Ruvang, Bartonville, TX (US)

(73) Assignee: Black Cat Blades Ltd., Edmonton (CA)

( * ) Notice: Subject to any disclaimer, the term of this patent is extended or adjusted under 35 U.S.C. 154(b) by 62 days.

(21) Appl. No.: 14/963,442

(22) Filed: Dec. 9, 2015

(65) Prior Publication Data

US 2016/0237658 A1 Aug. 18, 2016

(30) Foreign Application Priority Data

Feb. 13, 2015 (WO) ..... PCT/US15/15739

(51) Int. Cl.
*E02F 9/28* (2006.01)

(52) U.S. Cl.
CPC ..... *E02F 9/2883* (2013.01); *E02F 9/2825* (2013.01)

(58) Field of Classification Search
CPC ..... E02F 9/2825; E02F 9/2883
See application file for complete search history.

(56) References Cited

U.S. PATENT DOCUMENTS 1,003,663 A * 9/1911 Skelton ..... E02F 9/2825 37/454
3,736,664 A * 6/1973 Black ..... E02F 3/65 37/446
3,851,413 A * 12/1974 Lukavich ..... E02F 9/2816 37/450
4,027,408 A 6/1977 Ramella et al.
4,180,926 A * 1/1980 Klett ..... E02F 9/2833 37/455
4,414,764 A * 11/1983 Johansson ..... E02F 9/2841 37/450

(Continued)

FOREIGN PATENT DOCUMENTS

JP 2013-509513 A 3/2013
WO 2008051966 A2 5/2008

OTHER PUBLICATIONS

Australian Examination Report dated Nov. 14, 2016 for AU Patent Application No. 2015382413, 2 pages.

(Continued)

*Primary Examiner* — Jamie L McGowan
(74) *Attorney, Agent, or Firm* — Smith IP Services, P.C.

(57) ABSTRACT

A wear member attachment system for an excavation implement lip can include a wear member that protects an edge of the lip, and a wear member adapter that attaches the wear member to the lip, the wear member adapter being secured to the lip by a fastener, and the wear member being secured to the wear member adapter by another fastener. A method of protecting an excavation implement lip can include securing a wear member adapter to the implement, the wear member adapter including at least one receptacle, and inserting a protrusion on a wear member into the receptacle. Another system can include a wear member that protects a forward edge of a lip, and a wear member adapter that attaches the wear member to the lip between two adjacent teeth. The wear member can comprise a shroud and the adapter can wrap about an edge of the lip.

38 Claims, 8 Drawing Sheets

(56) References Cited

U.S. PATENT DOCUMENTS

| | | | | | |
|---|---|---|---|---|---|
| 4,716,667 | A | | 1/1988 | Martin | |
| 5,016,365 | A | * | 5/1991 | Robinson | E02F 3/40 37/451 |
| 5,063,696 | A | * | 11/1991 | Smith | E02F 9/2833 37/446 |
| 5,088,214 | A | * | 2/1992 | Jones | E02F 9/2883 172/772.5 |
| 5,553,409 | A | * | 9/1996 | Irving | A01B 15/02 172/719 |
| 5,634,285 | A | * | 6/1997 | Renski | E02F 9/2841 37/450 |
| 5,666,748 | A | * | 9/1997 | Emrich | E02F 9/2825 37/453 |
| 5,718,070 | A | | 2/1998 | Ruvang | |
| 5,765,301 | A | | 6/1998 | Clendenning | |
| 5,909,962 | A | | 6/1999 | Livesay et al. | |
| 5,937,550 | A | | 8/1999 | Emrich | |
| 6,108,950 | A | | 8/2000 | Ruvang et al. | |
| 6,145,224 | A | * | 11/2000 | Stickling | E02F 9/2841 37/456 |
| 6,393,739 | B1 | | 5/2002 | Shamblin et al. | |
| 6,430,851 | B1 | | 8/2002 | Clendenning | |
| 6,439,796 | B1 | | 8/2002 | Ruvang et al. | |
| 7,165,347 | B2 | | 1/2007 | Ollinger et al. | |
| 7,178,274 | B2 | | 2/2007 | Emrich | |
| 7,526,886 | B2 | | 5/2009 | McClanahan et al. | |
| 7,690,136 | B2 | * | 4/2010 | Breken | E02F 9/2825 37/452 |
| 7,707,755 | B2 | | 5/2010 | Lopez Almendros et al. | |
| 7,793,444 | B2 | * | 9/2010 | Jones | E02F 9/2825 37/453 |
| 7,980,011 | B2 | | 7/2011 | Ruvang | |
| 8,261,472 | B2 | | 9/2012 | Ruvang | |
| 8,307,574 | B2 | | 11/2012 | Ruvang | |
| 8,925,220 | B2 | * | 1/2015 | Stangeland | E02F 9/2883 37/452 |
| 2003/0037467 | A1 | | 2/2003 | Bierwith | |
| 2003/0101627 | A1 | | 6/2003 | Robinson et al. | |
| 2004/0098886 | A1 | * | 5/2004 | Hohmann | E02F 9/2833 37/451 |
| 2005/0095720 | A1 | | 5/2005 | Lorber et al. | |
| 2005/0132619 | A1 | | 6/2005 | Robinson | |
| 2007/0209189 | A1 | * | 9/2007 | Lopez Almendros | E02F 9/2825 29/525.01 |
| 2007/0256335 | A1 | * | 11/2007 | De Martiis | E02F 9/2825 37/444 |
| 2009/0199442 | A1 | * | 8/2009 | Woerman | E02F 9/2825 37/457 |
| 2012/0102790 | A1 | * | 5/2012 | Ruvang | E02F 9/2825 37/455 |
| 2012/0304505 | A1 | | 12/2012 | Ruvang | |
| 2013/0212916 | A1 | | 8/2013 | Stangeland et al. | |
| 2014/0202050 | A1 | | 7/2014 | Briscoe et al. | |
| 2015/0121729 | A1 | * | 5/2015 | Kunz | E02F 9/2883 37/451 |
| 2016/0160476 | A1 | * | 6/2016 | Serrurier | E02F 9/2825 37/450 |
| 2016/0237658 | A1 | * | 8/2016 | Ruvang | E02F 9/2825 |
| 2017/0044743 | A1 | * | 2/2017 | Balan | E02F 9/2883 |
| 2017/0058491 | A1 | * | 3/2017 | Kunz | E02F 9/2858 |

OTHER PUBLICATIONS

International Search Report with Written Opinion dated Oct. 21, 2015 for PCT Patent Application No. PCT/US2015/015739, 21 pages.

Hensley Industries, Inc.; "Bladesaver II", company brochure, received Jan. 30, 2015, 4 pages.

Specification and drawings for U.S. Appl. No. 12/408,880, filed Mar. 23, 2009, 44 pages.

Canadian Office Action dated Aug. 16, 2017 for CA Patent Application No. 2,943,615, 5 pages.

European Extended Search Report dated Nov. 17, 2017 for EP Patent Application No. 15882220.5, 11 pages.

Chinese Official Action dated Sep. 11, 2017 for JP Patent Application No. 2017-507673, 2 pages.

Translation of Chinese Official Action dated Sep. 11, 2017 for JP Patent Application No. 2017-507673, 2 pages.

* cited by examiner

WEAR MEMBERS FOR EXCAVATION IMPLEMENTS

CROSS-REFERENCE TO RELATED APPLICATION

This application claims the benefit under 35 USC § 119 of the filing date of International Application Serial No. PCT/US15/15739 filed 13 Feb. 2015. The entire disclosure of this prior application is incorporated herein by this reference.

BACKGROUND

This disclosure relates generally to equipment utilized and operations performed in conjunction with excavation and, in one example described below, more particularly provides improvements for wear members on excavation implements. Excavation implements can be used to break up, transport, load or otherwise handle ore, rocks, soil and other materials. Materials handled by excavation implements can be abrasive or can otherwise cause wear of the implements. Therefore, it will be readily appreciated that improvements are continually needed in the art of protecting excavation implements from wear.

DETAILED DESCRIPTION

Figure 1:
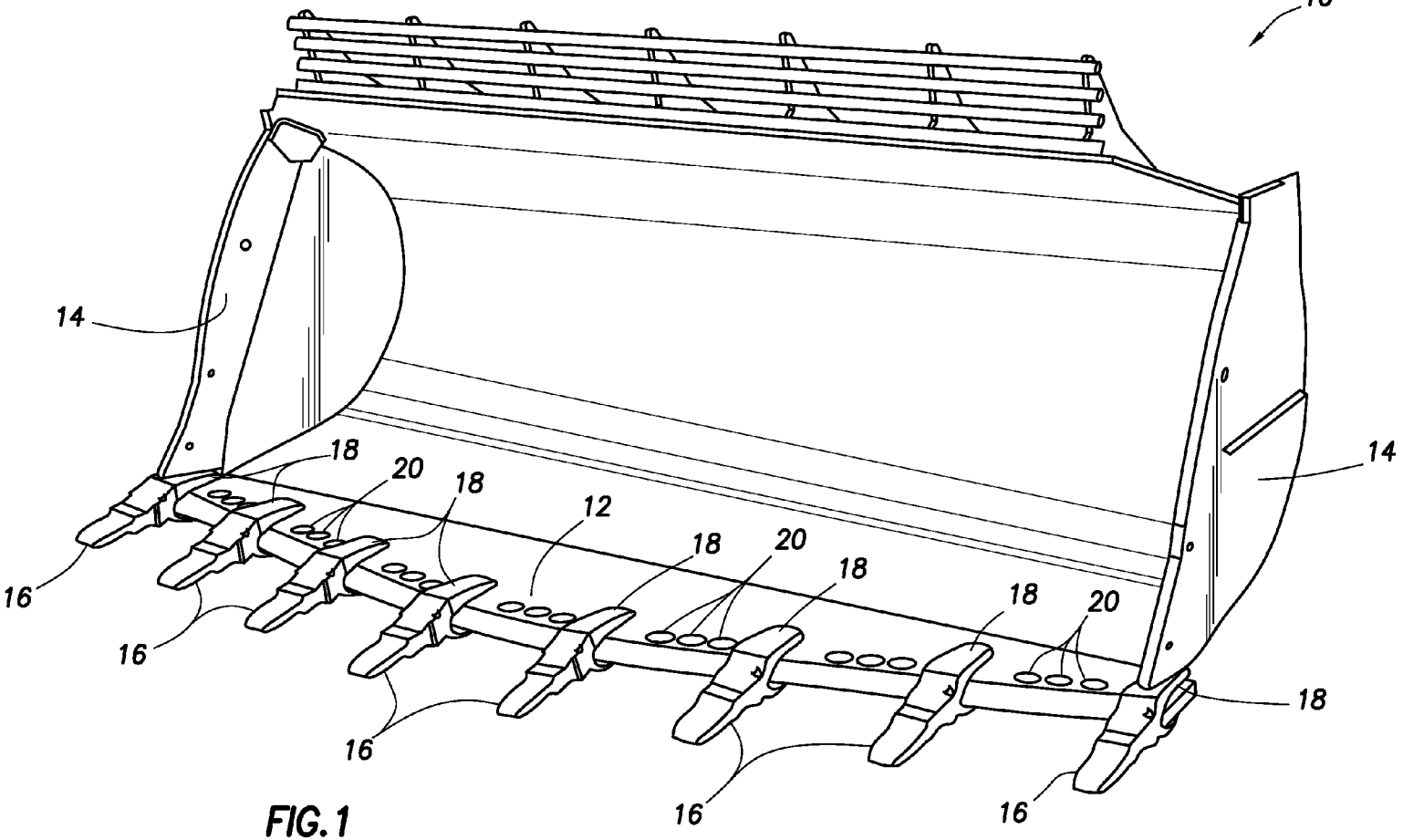
FIG. 1 is a representative perspective view of an excavation implement that can benefit from the principles of this disclosure.

Representatively illustrated in FIG. 1 is an example of an excavation implement 10 that can benefit from the principles of this disclosure. The implement 10 depicted in FIG. 1 is of the type known to those skilled in the art as a rock loader bucket, but it should be clearly understood that the scope of this disclosure is not limited to any particular type or configuration of excavation implement.

In the FIG. 1 example, the implement 10 includes a generally horizontal bottom lip 12 and two generally vertical side lips 14. Each of these lips 12, 14 can be subjected to wear due to excavation operations. Note that the descriptive terms "horizontal," "bottom," "vertical" and "side" used herein to describe the lips 12, 14 are merely in reference to the implement 10 as depicted in FIG. 1, and the scope of this disclosure is not limited to use with any particular orientation or location of an excavation implement lip.

Teeth 16 are spaced apart along the bottom lip 12. The teeth 16 are mounted to the lip 12 by means of respective tooth adapters 18. The adapters 18 provide for convenient replacement of the teeth 16. Typically, the adapters 18 are welded to the lip 12, and the teeth 16 are attached to the adapters using removable fasteners (not shown in FIG. 1).

Between adjacent pairs of the teeth 16 and adapters 18, openings 20 extend through the lip 12. The openings 20 provide for mounting shrouds (not shown in FIG. 1) to the lip 12 between the adjacent pairs of the teeth 16 and adapters 18.

The shrouds protect at least a bottom side of the lip 12 from damage and wear. The shrouds can also serve other purposes, such as providing for relatively even cutting across the bottom of the implement 10 (which, in turn, leaves a relatively smooth, consistent surface cut by the implement). Shrouds can also be provided for protecting the side lips 14 from damage and wear.

Unfortunately, past shroud designs have relied on attaching the shrouds directly to the implement 10 using multiple fasteners. The present inventor has recognized that such direct attachment of shrouds can be inconvenient, in that it requires removal and installation of the multiple fasteners, as well as any other wear members attached with the fasteners, in order to replace the shrouds. The fasteners are typically conventional bolts and nuts, which can be difficult to successfully remove after the implement 10 has been used for excavating operations long enough to require replacement of the shrouds.

Figure 2:
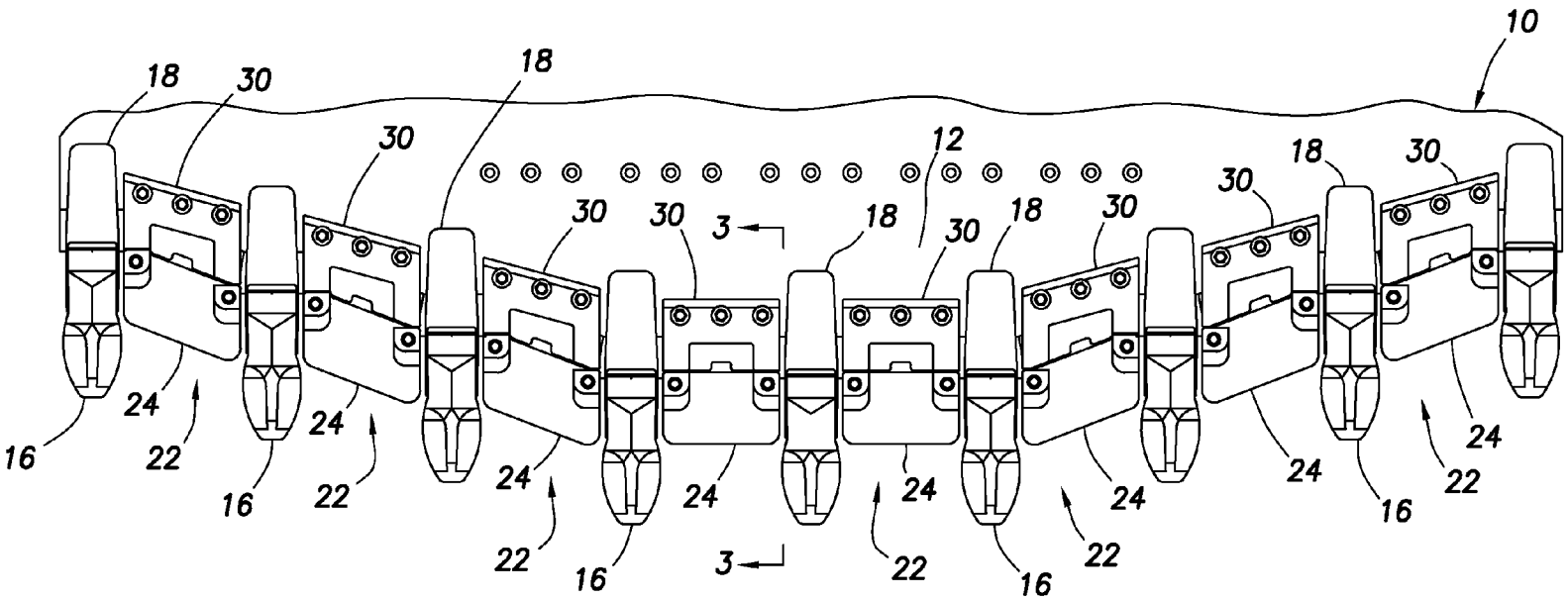
FIG. 2 is a representative plan view of a wear member attachment system that can embody the principles of this disclosure.

Referring additionally now to FIG. 2, representatively illustrated are wear member attachment systems 22 and an associated method which can embody principles of this disclosure. However, it should be clearly understood that the systems 22 and method are merely one example of an application of the principles of this disclosure in practice, and a wide variety of other examples are possible. Therefore, the scope of this disclosure is not limited at all to the details of the system 22 and method described herein and/or depicted in the drawings.

Each system 22 is used to attach a wear member 24 to an excavation implement lip. In the FIG. 2 example, the wear members 24 comprise shrouds, and the systems 22 are used to attach the wear members 24 to the bottom lip 12 of the implement 10 of FIG. 1. However, it should be understood that the systems 22 may be used to attach other types of wear members, and the systems may be used to attach wear members to other lips (such as the side lips 14) and other excavation implements, in keeping with the principles of this disclosure.

As depicted in FIG. 2, each of the systems 22 is positioned between an adjacent pair of the teeth 16 and tooth adapters 18. In this manner, the wear members 24 can protect the lip 12 from wear between each pair of tooth adapters 18 that are closest to each other.

However, the scope of this disclosure is not limited to use of the systems 22 between adjacent pairs of the teeth 16 or tooth adapters 18. In some examples, a system 22 may not be positioned between a pair of teeth or tooth adapters. In one example, the system 22 may be used on the side lips 14, in which case the system would not be positioned between teeth or tooth adapters at all.

In the FIG. 2 example, the wear member 24 protects both a forward edge 26 and a bottom surface 28 of the lip 12 (not visible in FIG. 2, see FIGS. 3-8). A separate wear member 30 is provided in this example for protecting an upper surface 32 of the lip 12.

However, in other examples, the wear member 30 may not be used, or it may be combined with the wear member 24. Thus, the scope of this disclosure is not limited to use of any particular locations, number, configurations or combinations of wear members in the system 22.

Figure 3:
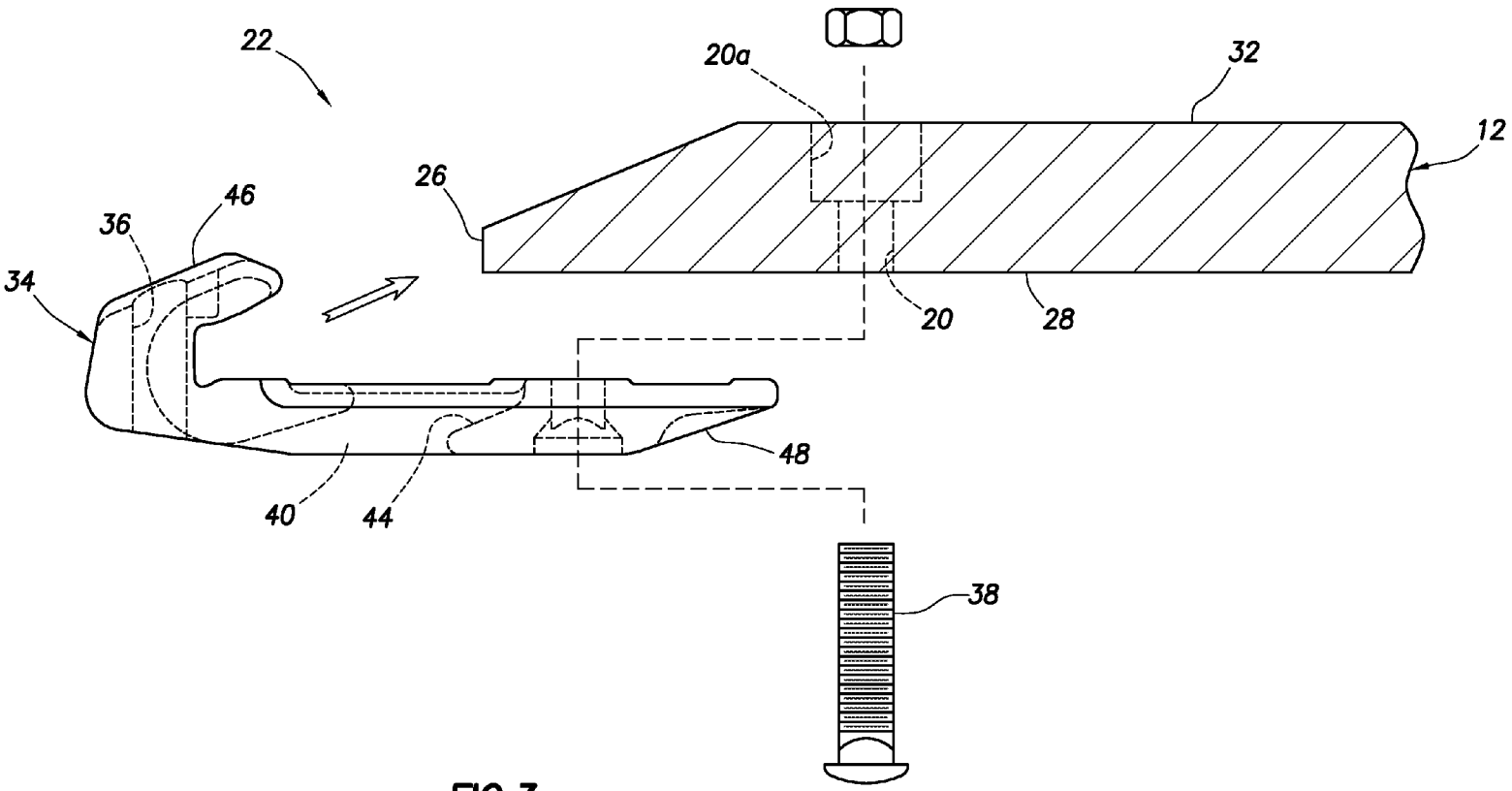
FIG. 3 is an enlarged scale representative partially cross-sectional view of the system, taken along line 3-3 of FIG. 2.

Referring additionally now to FIG. 3, a partially cross-sectional view of the system 24 and lip 12 is representatively illustrated, taken along line 3-3 of FIG. 2. In this view, a wear member adapter 34 is being positioned on the lip 12. The wear member adapter 34 provides for convenient and secure attachment of the wear member 24 to the lip 12, and provides for ease of removing the wear member from the lip.

In this example, the adapter 34 wraps about the forward edge 26 of the lip 12. This configuration allows for sufficient material volume in the adapter 34 to extend a fastener receiving opening 36 through a forward end of the adapter for attaching the wear member 24 to the adapter. However, it is not necessary for the adapter 34 to wrap about the forward edge 26 of the lip 12, or for the fastener receiving opening 36 to be formed in the forward end of the adapter, in keeping with the principles of this disclosure.

Fasteners 38 (only one of which is visible in FIG. 3) are used to secure the adapter 34 to the lip 12. In this example, the fastener 38 includes a threaded bolt and nut, but other types of fasteners may be used in other examples.

The nut is received in a radially enlarged portion 20*a* of the opening 20. The bolt can extend upwardly from the nut and protrude from the upper surface 32 of the lip 12, in order to provide for attachment of the wear member 30, if desired (see FIGS. 5-8 and accompanying description below).

The adapter 34 includes one or more receptacles 40 for receiving therein one or more protrusions 42 (not shown in FIG. 3, see FIG. 5) formed on the wear member 24. Each receptacle 40 includes an inclined surface 44 that deflects the wear member 24 toward the lip 12 as the wear member is installed on the adapter 34, thereby retaining a rearward portion of the wear member.

The inclined surface 44 can be one of multiple inclined surfaces 44, 46, 48 on the adapter 34 that are parallel to each other. The parallel surfaces 44, 46, 48 engage corresponding parallel surfaces 50, 52, 54 formed on the wear member 24 (see FIG. 5) when the wear member is attached to the adapter 34. Such engagement between the parallel surfaces 44, 46, 48 and 50, 52, 54 allows the wear member 24 to be more easily displaced downwardly and forwardly relative to the lip 12 when the wear member is being replaced.

Figure 4:
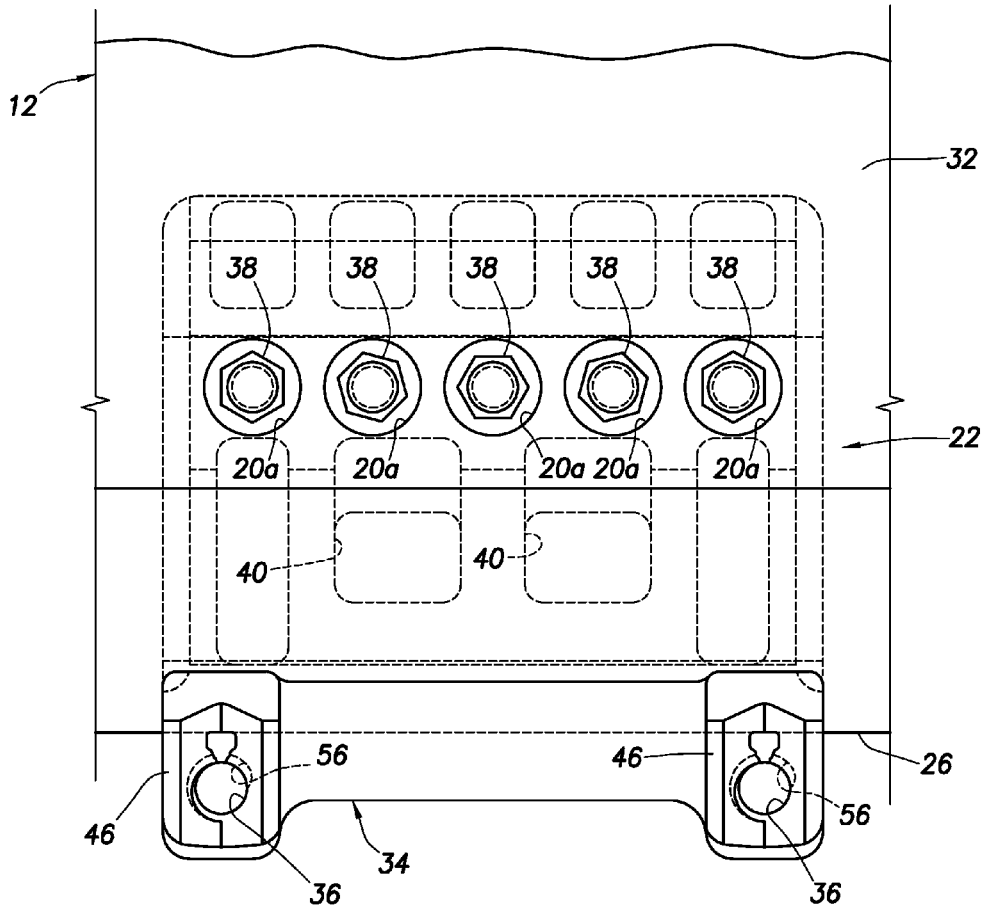
FIG. 4 is a representative plan view of the system, with a wear member adapter secured to an excavation implement lip.

Referring additionally now to FIG. 4, a plan view of the system 24 is representatively illustrated, after the adapter 34 has been secured to the lip 12. Note that five of the fasteners 38 are depicted in FIG. 4, but any number of fasteners may be used in keeping with the principles of this disclosure.

Note that an internal thread 56 is associated with each of the fastener receiving openings 36. The thread 56 is eccentric relative to its associated opening, for use with a specially configured fastener, as described more fully below.

Figure 5:
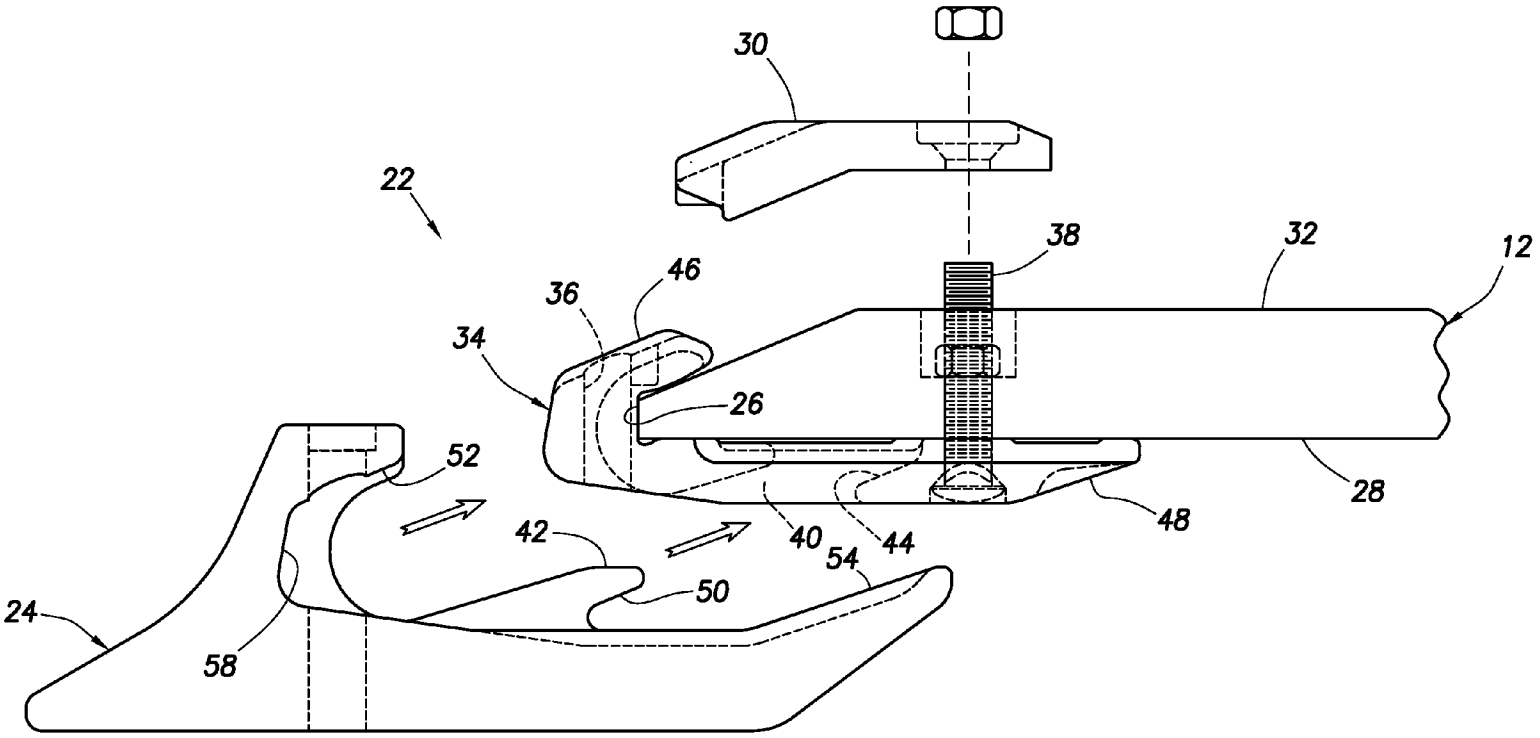
FIG. 5 is a representative partially cross-sectional view of the system, with a shroud and a wear plate being positioned on the lip and wear member adapter.

Referring additionally now to FIG. 5, the system 22 is representatively illustrated as the wear members 24, 30 are being attached to the adapter 34 and lip 12. The fasteners 38 are used to attach the wear member 30, so that it overlies the upper surface 32 of the lip 12. The wear member 24 is installed onto the adapter 34, so that the surfaces 44, 46, 48 are engaged with the respective surfaces 50, 52, 54, and so that a forward end of the adapter is received in a recess 58 formed in the wear member.

Figure 6:
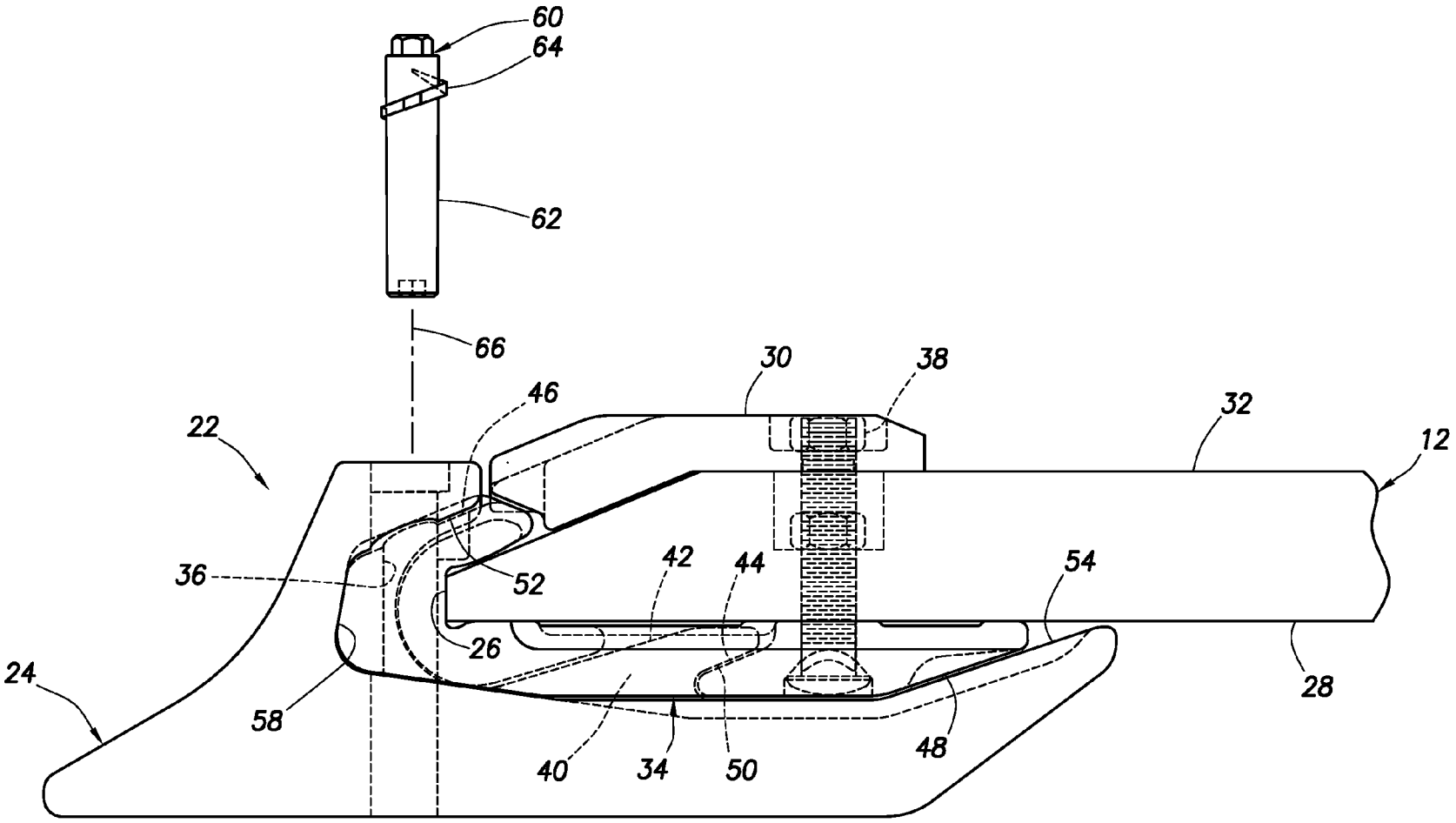
FIG. 6 is a representative partially cross-sectional view of the system, with a fastener being used to attach the shroud to the wear member adapter.

Referring additionally now to FIG. 6, the system 22 is representatively illustrated, after the wear member 30 has been attached on the upper surface 32 of the lip 12, and the wear member 24 has been engaged with the adapter 34. The wear member 24 is now secured to the adapter 34 by means of a specially configured fastener 60.

The fastener 60 has a generally cylindrical body 62, with an eccentrically formed thread 64 (the thread is off-center relative to a longitudinal axis 66 of the body 62). A similar fastener, used to attach a tooth to a tooth adapter, is described in U.S. Pat. No. 8,261,472, the entire disclosure of which is incorporated herein by this reference.

Note that the fastener 60, when installed in the wear member 24 and adapter 34 is oriented orthogonal to the lip 12. That is, a longitudinal axis 66 of the fastener 60 is perpendicular to the upper and lower surfaces 28, 32 of the lip 12. This orientation provides for convenient installation and removal of the fastener 60, with the wear member 24 and adapter 34 being positioned between an adjacent pair of the teeth 16 and tooth adapters 18. However, other orientations of the fastener 60 may be used in other examples, in keeping with the principles of this disclosure.

Figure 7:
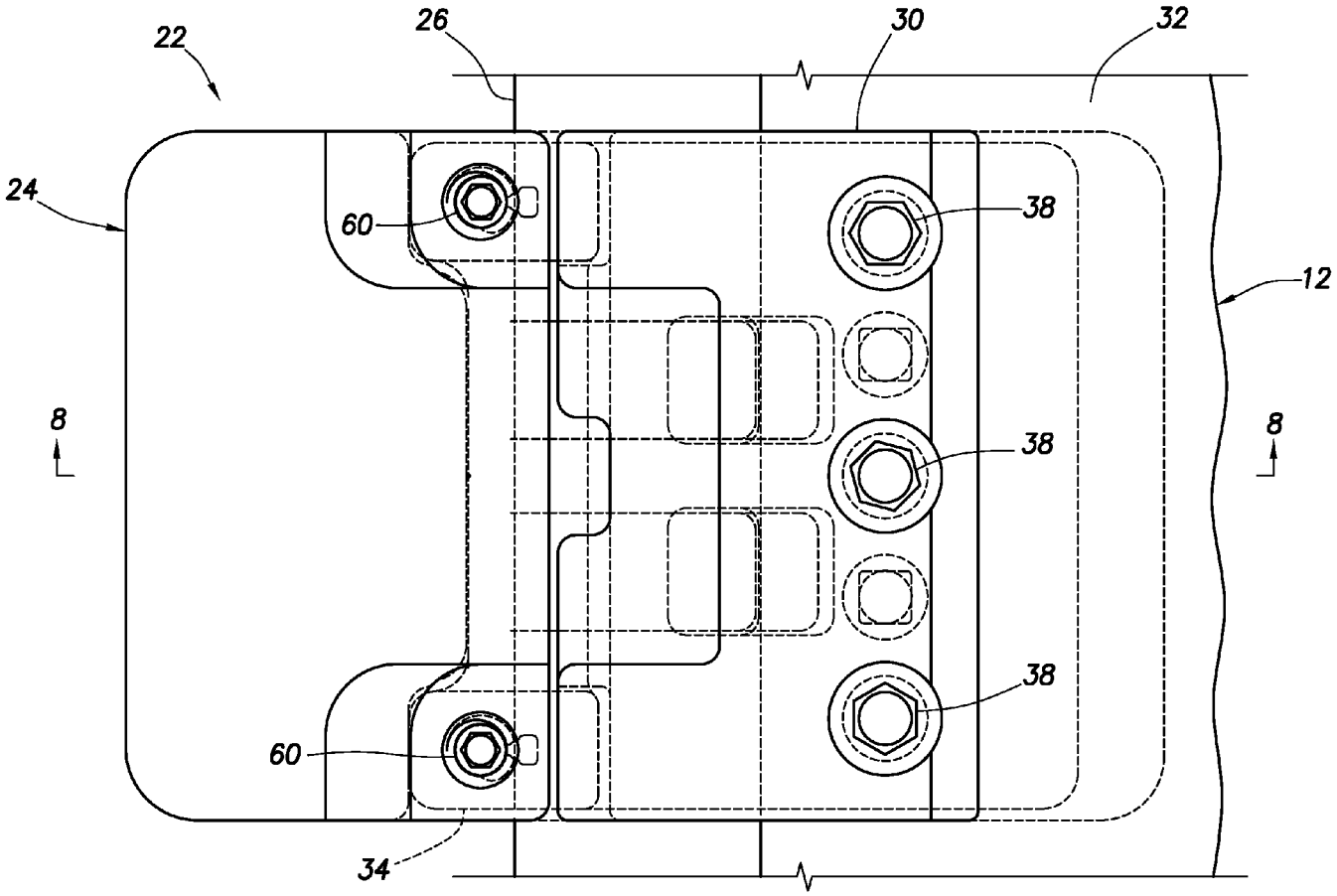
FIG. 7 is a representative plan view of the system, with the shroud and wear plate installed.

Referring additionally now to FIG. 7, the system 22 is representatively illustrated with the wear members 24, 30 attached to the lip 12 and adapter 34. In this configuration, the wear member/shroud 24 protects the forward edge 26 and bottom surface 28 of the lip 12, and the wear member/wear plate 30 protects the upper surface 32 of the lip.

Figure 8:
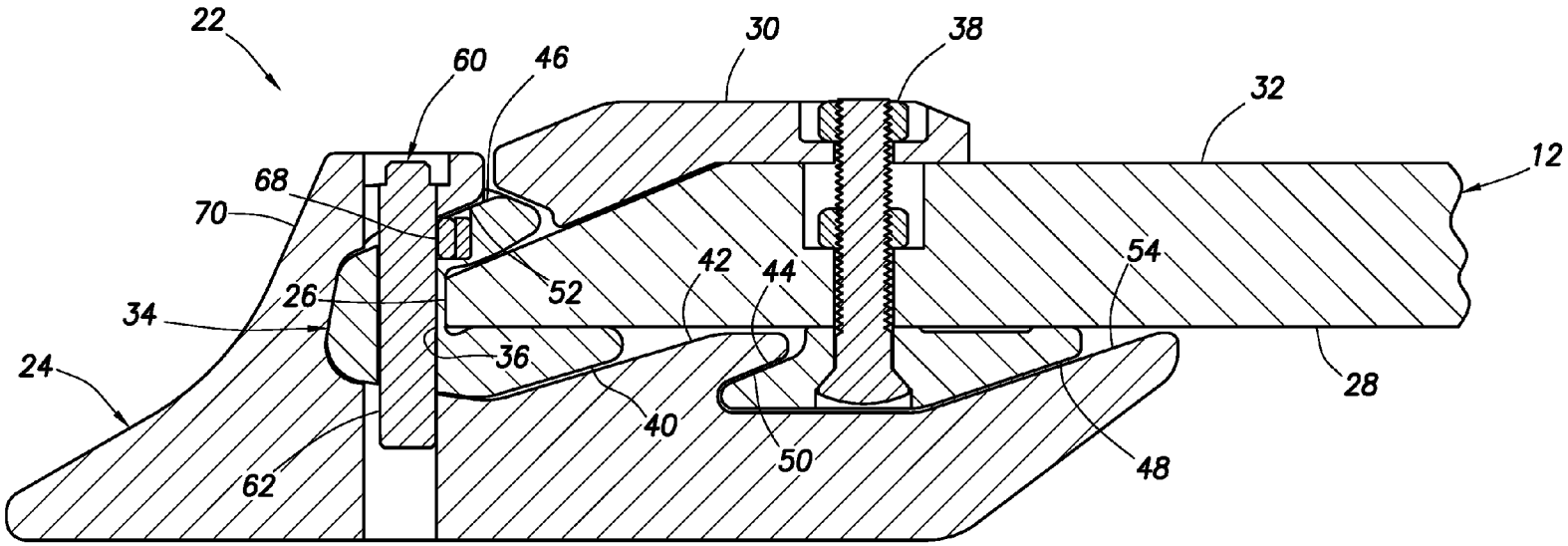
FIG. 8 is a representative cross-sectional view of the system, taken along line 8-8 of FIG. 7.

Referring additionally now to FIG. 8, a cross-sectional view of the system 22 is representatively illustrated, taken along line 8-8 of FIG. 7. In this view, a locking device 68 that engages the thread 64 of the fastener 60 and thereby prevents unthreading of the fastener can be seen. The front edge 26, bottom surface 28 and upper surface 32 of the lip 12 are now protected from damage and wear by the wear members 24, 30.

It may now be fully appreciated that the above disclosure provides significant advancements to the art of preventing wear of excavation implements. In examples described above, the wear member 24 is conveniently attachable to, and removable from, the lip 12 (and/or lips 14) by means of the wear member adapter 34.

A wear member attachment system 22 for a lip 12, 14 of an excavation implement 10 is provided to the art by the above disclosure. In one example, the system 22 can include a wear member 24 that protects a forward edge 26 of the lip 12, and a wear member adapter 34 that provides for attachment of the wear member 24 to the lip 12. The wear member adapter 34 is secured to the lip 12 by one or more first fasteners 38, and the wear member 24 is secured to the wear member adapter 34 by one or more second fasteners 60.

The second fastener 60 can include a thread 64 that is eccentric relative to a body 62 of the second fastener. The second fastener 60 may be oriented orthogonal relative to the lip 12.

The wear member adapter 34 may be positioned between two tooth adapters 18 nearest to each other on the lip 12. The wear member adapter 34 can be positioned between the lip 12 and the wear member 24, such as, between the wear member and a bottom surface 28 of the lip, or between the wear member and a forward edge 26 of the lip.

The wear member 24 can comprise a shroud. The shroud 24 may be positioned between two adjacent teeth 16, the shroud being rearward of the teeth.

The wear member adapter 34 may include at least one receptacle 40. The wear member 24 may include at least one protrusion 42 received in the receptacle 40.

Parallel surfaces 50, 52, 54 on the wear member 24 may be engaged with parallel surfaces 44, 46, 48 on the wear member adapter 34. At least one of the wear member parallel surfaces 50, 52, 54 can be formed on the protrusion 42, and at least one of the wear member adapter parallel surfaces 44, 46, 48 can be formed in the receptacle 40. The wear member parallel surfaces 50, 52, 54 and the wear member adapter parallel surfaces 44, 46, 48 may be inclined relative to the lip 12.

A method of protecting a lip 12, 14 of an excavation implement 10 is also provided to the art by the above disclosure. In one example, the method can comprise: securing a wear member adapter 34 to the implement 10, the wear member adapter 34 including at least one receptacle 40; and engaging a wear member 24 with the wear member adapter 34, the engaging step comprising inserting at least one protrusion 42 on the wear member 24 into the receptacle 40.

The securing step can include extending fasteners 38 through the lip 12 and the wear member adapter 34.

The securing step can include positioning the wear member adapter 34 between two tooth adapters 18 that are nearest to each other on the lip 12.

The securing step can include the wear member adapter 34 overlapping a forward edge 26 of the lip 12. Note that it is not necessary in keeping with the principles of this disclosure for the wear member adapter 34 or the wear member 24 to overlap or wrap about the forward edge 26 of the lip 12.

The method can include fastening the wear member 24 to the wear member adapter 34 with at least one fastener 60. The fastener 60 can be oriented orthogonal to the lip 12. The fastener 60 can include a thread 64 that is eccentric relative to a body 62 of the fastener.

The engaging step can include positioning the wear member adapter 34 between the wear member 24 and the lip 12, such as, between the wear member and a bottom surface 28 of the lip, or between the wear member and a forward edge 26 of the lip.

The engaging step can include engaging parallel surfaces 50, 52, 54 on the wear member 24 with parallel surfaces 44, 46, 48 on the wear member adapter 34.

Also described above is a wear member attachment system 22 for a lip 12, 14 of an excavation implement 10, with the system comprising: a wear member 24 that protects a forward edge 26 of the lip 12, and a wear member adapter 34 that provides for attachment of the wear member 24 to the lip 12. The wear member adapter 34 is fastened to the lip 12 between two adjacent teeth 16. The wear member adapter 34 may also be fastened to the lip 12 between two adjacent tooth adapters 18.

A shroud (e.g., wear member 24) for protecting a lip 12, 14 of an excavator implement 10 is also described above. In one example, the shroud can include a body 70 that wraps around a forward edge 26 of the lip 12, and a protrusion 42 that extends from the body 70 and into a receptacle 40 in a wear member adapter 34 secured to the lip 12. A surface 50 on the protrusion 42 engages a surface 44 in the receptacle 40, the receptacle surface 44 facing at least partially forward and being inclined relative to the lip 12. The engagement between the protrusion surface 50 and the receptacle surface 44 deflects the body 70 toward the lip 12.

The receptacle surface 44 can be one of multiple parallel surfaces 44, 46, 48 formed on the wear member adapter 34. The protrusion surface 50 can be one of multiple parallel surfaces 50, 52, 54 formed on the shroud.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wear member attachment system for a lip of an excavation implement, the system comprising:

a first wear member including a first portion which protects a lowermost surface of the lip, a second portion which protects an upper surface of the lip, and a protrusion which extends angularly from the first portion; and a wear member adapter that provides for attachment of the first wear member to the lip, wherein the wear member adapter is secured to the lip by at least one first fastener, wherein interaction between the protrusion and a receptacle on the wear member adapter deflects the first wear member toward the lip as the first wear member is installed on the wear member adapter, and wherein the first wear member is secured to the wear member adapter by at least one second fastener.

2. The system of claim 1, wherein the second fastener comprises a thread that is eccentric relative to a body of the second fastener.

3. The system of claim 1, wherein the wear member adapter is positioned between two tooth adapters nearest to each other on the lip.

4. The system of claim 1, wherein the first wear member comprises a shroud.

5. The system of claim 4, wherein the shroud is positioned between two adjacent teeth, the shroud being rearward of the teeth.

6. The system of claim 1, wherein the wear member adapter is positioned between the lip and the first wear member.

7. The system of claim 1, wherein the wear member adapter includes at least one receptacle, and wherein the first wear member includes at least one protrusion received in the receptacle.

8. The system of claim 7, wherein parallel surfaces on the first wear member are engaged with parallel surfaces on the wear member adapter, at least one of the first wear member parallel surfaces being formed on the protrusion, and at least one of the wear member adapter parallel surfaces being formed in the receptacle.

9. The system of claim 7, wherein parallel surfaces on the first wear member are engaged with parallel surfaces on the wear member adapter, the first wear member parallel surfaces and the wear member adapter parallel surfaces being inclined relative to the lowermost surface of the lip.

10. The system of claim 1, wherein the second fastener is oriented orthogonal relative to the lip.

11. The system of claim 1, wherein a second wear member is secured to the lip via the at least one first fastener.

12. A method of protecting a lip of an excavation implement, the method comprising:

securing a wear member adapter to the implement, the wear member adapter including at least one receptacle; and engaging a wear member with the wear member adapter, the wear member comprising a first portion which protects a lowermost surface of the lip, a second portion which protects an upper surface of the lip, and at least one protrusion which extends angularly from the first portion, and the engaging comprising inserting the at least one protrusion into the receptacle, wherein interaction between the protrusion and the receptacle deflects the wear member toward the lip as the wear member is being installed on the wear member adapter.

13. The method of claim 12, wherein the securing further comprises extending fasteners through the lip and the wear member adapter.

14. The method of claim 12, wherein the securing further comprises positioning the wear member adapter between two tooth adapters that are nearest to each other on the lip.

15. The method of claim 12, wherein the securing further comprises the wear member adapter overlapping a forward edge of the lip.

16. The method of claim 12, wherein the wear member comprises a shroud.

17. The method of claim 12, further comprising fastening the wear member to the wear member adapter with at least one fastener, the fastener being oriented orthogonal to the lip.

18. The method of claim 12, further comprising fastening the wear member to the wear member adapter with at least one fastener, the fastener comprising a thread that is eccentric relative to a body of the fastener.

19. The method of claim 12, wherein the engaging further comprises positioning the wear member adapter between the wear member and the lip.

20. The method of claim 12, wherein the engaging further comprises engaging parallel surfaces on the wear member with parallel surfaces on the wear member adapter, the wear member parallel surfaces and the wear member adapter parallel surfaces being inclined relative to the lowermost surface of the lip.

21. The method of claim 12, wherein the engaging further comprises engaging parallel surfaces on the wear member with parallel surfaces on the wear member adapter, at least one of the wear member parallel surfaces being formed on the protrusion, and at least one of the wear member adapter parallel surfaces being formed in the receptacle.

22. A wear member attachment system for a lip of an excavation implement, the system comprising:

a wear member including a first portion which protects a lowermost surface of the lip, a second portion which protects an upper surface of the lip, and a protrusion which extends angularly from the first portion; and a wear member adapter that provides for attachment of the wear member to the lip, the wear member adapter being fastened to the lip between two adjacent teeth, wherein the wear member adapter includes at least one receptacle, wherein a surface on the protrusion engages a surface on the receptacle, the receptacle surface facing at least partially forward and being inclined relative to the lowermost surface of the lip, and wherein engagement between the protrusion and the receptacle retains the first portion of the wear member on the wear member adapter.

23. The system of claim 22, wherein the wear member adapter is fastened to the lip between two adjacent tooth adapters.

24. The system of claim 22, wherein the wear member adapter is secured to the lip by at least one first fastener oriented orthogonal to the lip, and wherein the wear member is fastened to the wear member adapter by at least one second fastener oriented orthogonal to the lip.

25. The system of claim 24, wherein the second fastener comprises a thread that is eccentric relative to a body of the second fastener.

26. The system of claim 22, wherein the wear member comprises a shroud.

27. The system of claim 22, wherein parallel surfaces on the wear member are engaged with parallel surfaces on the wear member adapter, at least one of the wear member parallel surfaces being formed on the protrusion, and at least one of the wear member adapter parallel surfaces being formed in the receptacle.

28. The system of claim 22, wherein parallel surfaces on the wear member are engaged with parallel surfaces on the wear member adapter, the wear member parallel surfaces and the wear member adapter parallel surfaces being inclined relative to the lowermost surface of the lip.

29. The system of claim 22, wherein the wear member adapter wraps around a forward edge of the lip.

30. A shroud for protecting a lip of an excavator implement, the shroud comprising:

a first portion which protects a lowermost surface of the lip;

a second portion which protects an upper surface of the lip; and a protrusion that extends angularly from the first portion and into a receptacle in a wear member adapter secured to the lip, wherein a surface on the protrusion engages a surface on the receptacle, the receptacle surface facing at least partially forward and being inclined relative to the lowermost surface of the lip, and wherein the engagement between the protrusion surface and the receptacle surface retains the first portion of the shroud on the wear member adapter.

31. The shroud of claim 30, wherein the receptacle surface is one of multiple parallel surfaces formed on the wear member adapter, and wherein the protrusion surface is one of multiple parallel surfaces formed on the shroud.

32. The shroud of claim 30, wherein the wear member adapter is fastened to the lip between two adjacent teeth.

33. The shroud of claim 30, wherein the wear member adapter is fastened to the lip between two adjacent tooth adapters.

34. The shroud of claim 30, wherein the wear member adapter is secured to the lip by at least one first fastener oriented orthogonal to the lip.

35. The shroud of claim 34, wherein the shroud is fastened to the wear member adapter by at least one second fastener.

36. The shroud of claim 35, wherein the second fastener comprises a thread that is eccentric relative to a body of the second fastener.

37. The shroud of claim 35, wherein the second fastener is oriented orthogonal to the lip.

38. The shroud of claim 30, wherein the wear member adapter wraps around a forward edge of the lip.

* * * * *